US008839775B2

(12) United States Patent
Wasilewski et al.

(10) Patent No.: US 8,839,775 B2
(45) Date of Patent: Sep. 23, 2014

(54) ARCHERY BOW LIMB DAMPENING SYSTEM

(75) Inventors: Don Wasilewski, Stansbury Park, UT (US); Brian Gold, Tooele, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 124 days.

(21) Appl. No.: 13/584,803

(22) Filed: Aug. 13, 2012

(65) Prior Publication Data

US 2014/0041645 A1 Feb. 13, 2014

(51) Int. Cl.
*F41B 5/20* (2006.01)

(52) U.S. Cl.
USPC ..... 124/89

(58) Field of Classification Search
CPC ..... F41B 5/10; F41B 5/12; F41B 5/123; F41B 5/1426
USPC ..... 124/25.6, 86, 88, 89
See application file for complete search history.

(56) References Cited

U.S. PATENT DOCUMENTS

| | | | | |
|---|---|---|---|---|
| 2,609,810 | A * | 9/1952 | Gruner | 124/25 |
| 3,757,761 | A * | 9/1973 | Izuta | 124/23.1 |
| 5,517,979 | A * | 5/1996 | Closson | 124/86 |
| 6,257,220 | B1 * | 7/2001 | McPherson et al. | 124/89 |
| 6,298,842 | B1 | 10/2001 | Sims | |
| 6,526,957 | B1 | 3/2003 | Leven | |
| 6,684,870 | B1 * | 2/2004 | Land | 124/23.1 |
| 2008/0264400 | A1 * | 10/2008 | Wright | 124/89 |
| 2009/0133683 | A1 * | 5/2009 | Wright | 124/89 |
| 2010/0269810 | A1 * | 10/2010 | Goade | 124/89 |

* cited by examiner

*Primary Examiner* — John Ricci
(74) *Attorney, Agent, or Firm* — Holland & Hart

(57) ABSTRACT

An archery bow includes a riser, first and second limbs, a bowstring, and a vibration dampening assembly. The riser includes opposing ends and the first and second limbs extend from the opposing ends of the riser. The bowstring extends between the first and second limbs. The vibration dampening assembly includes a dampening member and a cantilever member having a first end mounted to the riser and a second end supporting the dampening member. The dampening member is suspended by the cantilever member out of contact with the first limb when the archery bow is drawn and contacts the first limb to dampen vibrations when the archery bow is released.

23 Claims, 11 Drawing Sheets

ARCHERY BOW LIMB DAMPENING SYSTEM

BACKGROUND

Impact-induced vibrations result when using archery bows and related archery equipment. An oscillating system typically vibrates with respect to at least one resonant frequency (e.g., for each degree of freedom of the system). In addition, an oscillating system may also vibrate at harmonics of the resonant frequency (i.e., twice the resonance frequency, four times the resonance frequency, etc.). Of course, an oscillating system may also vibrate, to a lesser extent, at other frequencies as may be excited therein. The resonant frequency of a system may be generally proportional to a constant, commonly referred to as the spring constant or spring coefficient, and to the mass of the system. An oscillating system may also have an internal damping factor associated therewith which dampens or diminishes, over time, the amplitude of the oscillations. However, among other reasons, because archery bows are preferentially light to make the archery bow easier to carry and shoot, and relatively stiff, such internal dampening may be relatively minute or ineffective for dampening vibrations of a bow system.

Relative to archery systems, when an arrow is launched from an archery bow, the bow may be described as an oscillating system. For example, in anticipation of shooting an arrow at an intended target, an archer nocks an arrow on the bowstring and draws the archery bow. Drawing the bowstring stores potential energy in the bow limbs. When the bowstring is released, most of the stored potential energy is transferred to the arrow, causing the arrow to fly according to the magnitude and direction of the force imparted to the arrow. Generally, at least some portion of the potential energy is not transferred to the arrow, but instead is absorbed by the bow. Ideally, if all of the stored energy were transferred to the arrow, or were otherwise dissipated or stored, the bow would not vibrate after release of the arrow. Due to the physics, mechanics, and dynamics of the bow and arrow system configuration, such vibration may be difficult, if not impossible, to eliminate completely.

Accordingly, a recoil or kick, in combination with attendant vibration, may be felt by the archer. Such vibrations inevitably result in problems for the bow hunter or archer. Specifically, such vibrations give rise to undesirable noise, may influence accuracy in shooting, may cause physical discomfort to the archer's hand and arm, and may cause undesirable wear and tear on the archery bow and string.

Dampening devices have been used in many ways to reduce vibrations in archery bows. One conventional approach for lessening the effects of archery bow system vibration has been to use dampening devices in combination with stabilizers. Stabilizers with dampening material incorporated therein are mounted to the bow riser and are designed to reduce torque and absorb vibration generated upon release of an arrow. Mechanical dampers incorporated into stabilizers are also used to reduce bow vibrations.

In addition, dampening devices have been mounted to other areas of the bow, including the riser, the limbs, and the bowstring. In one type of conventional mechanical damper, a metal cylinder may be filled with oil and a piston in the cylinder is allowed to travel back and forth within the oil-filled cylinder to dampen vibrations. Another type of bow stabilizer is a rod and mass system. Rod and mass stabilizers include a system of movable weights to tune the stabilizer resonant frequency to that of the natural frequency of the system.

Accordingly, it would be advantageous to provide improved dampening apparatuses and structures for dampening vibrations of archery bows and archery accessories.

SUMMARY

One aspect of the present disclosure relates to an archery bow that includes a riser, first and second limbs, a bowstring, and a vibration dampening assembly. The riser includes opposing ends. The first and second limbs extend from the opposing ends of the riser. The bowstring extends between the first and second limbs. The vibration dampening assembly includes a dampening member and a cantilever member having a first end mounted to the riser and a second end supporting the dampening member. The dampening member is suspended by the cantilever member out of contact with the first limb when the archery bow is drawn and contacts the first limb to dampen vibrations when the archery bow is released.

The riser may include first and second limb pockets, wherein the first and second limbs are connected to the riser at the first and second limb pockets, respectively, and the cantilever member is connected to the riser at the first limb pocket. The cantilever member may include a cantilever bracket that couples the cantilever member to the riser. The first and second limbs may be split limbs having a channel formed therein, and the cantilever member is positioned in the channel. The first and second limbs may have a front surface and a rear surface, wherein the rear surface faces the bowstring, and the dampening member contacts the front surface.

The cantilever member may have a rest position and a biased position, wherein releasing the archery bow moves the cantilever member from the rest position into the biased position. The dampening member may comprise an elastomeric material such as Santoprene™. The cantilever member may comprise a different material than that of the dampening member. The vibration dampening assembly may include a cantilever bracket configured to connect the cantilever member to the riser. The first limb may include first and second end portions, wherein the first end portion is connected to the riser and the second end portion carries a cam of the archery bow, and the dampening member contacts the first limb at a location spaced between the first and second end portions. The archery bow may include first and second vibration dampening assemblies that each includes a dampening member and a cantilever member, wherein the first vibration dampening assembly is mounted at one end of the riser and arranged to contact the first limb, and the second vibration dampening assembly is mounted to an opposite end of the riser and arranged to contact the second limb.

Another aspect of the present disclosure relates to an archery bow dampening assembly that includes a dampening member and a cantilever member. The cantilever member includes a first end configured to be coupled to a riser of an archery bow and a second end connected to the dampening member. The cantilever member is operable to hold the dampening member out of contact with a limb of the archery bow when the archery bow is drawn and allow the dampening member to contact the limb to dampen vibrations when the archery bow is released.

The archery bow may include a cantilever bracket configured to connect the cantilever member to the riser. The dampening member may include a plurality of dampening segments arranged adjacent to each other along a length dimension of the limb. The cantilever member may be configured to be coupled to a limb pocket of the riser.

A further aspect of the present disclosure relates to a method of stabilizing an archery bow. The method includes providing an archery bow having a riser, first and second limbs extending from limb pockets of the riser, and a dampening member. The method also includes spacing the dampening member away from the first limb when the archery bow is in the drawn position and contacting the dampening member with the first limb when the archery bow is released from the drawn position to dampen vibrations in the archery bow.

The archery bow may include a cantilever member having a first end connected to at least one of the riser and the first limb, and a second end connected to the dampening member, wherein the cantilever member holds the dampening member away from the first limb when the archery bow is in the drawn position. The first limb may move away from the dampening member when the archery bow is in the drawn position. The first limb may have a front surface and a rear surface, wherein the dampening member is arranged to contact the front surface. The method may include dampening vibrations with the cantilever member when the dampening member contacts the first limb.

The foregoing and other features, utilities, and advantages of the subject matter described herein will be apparent from the following more particular description of certain embodiments as illustrated in the accompanying drawings.

DRAWINGS

DETAILED DESCRIPTION

Figure 1:
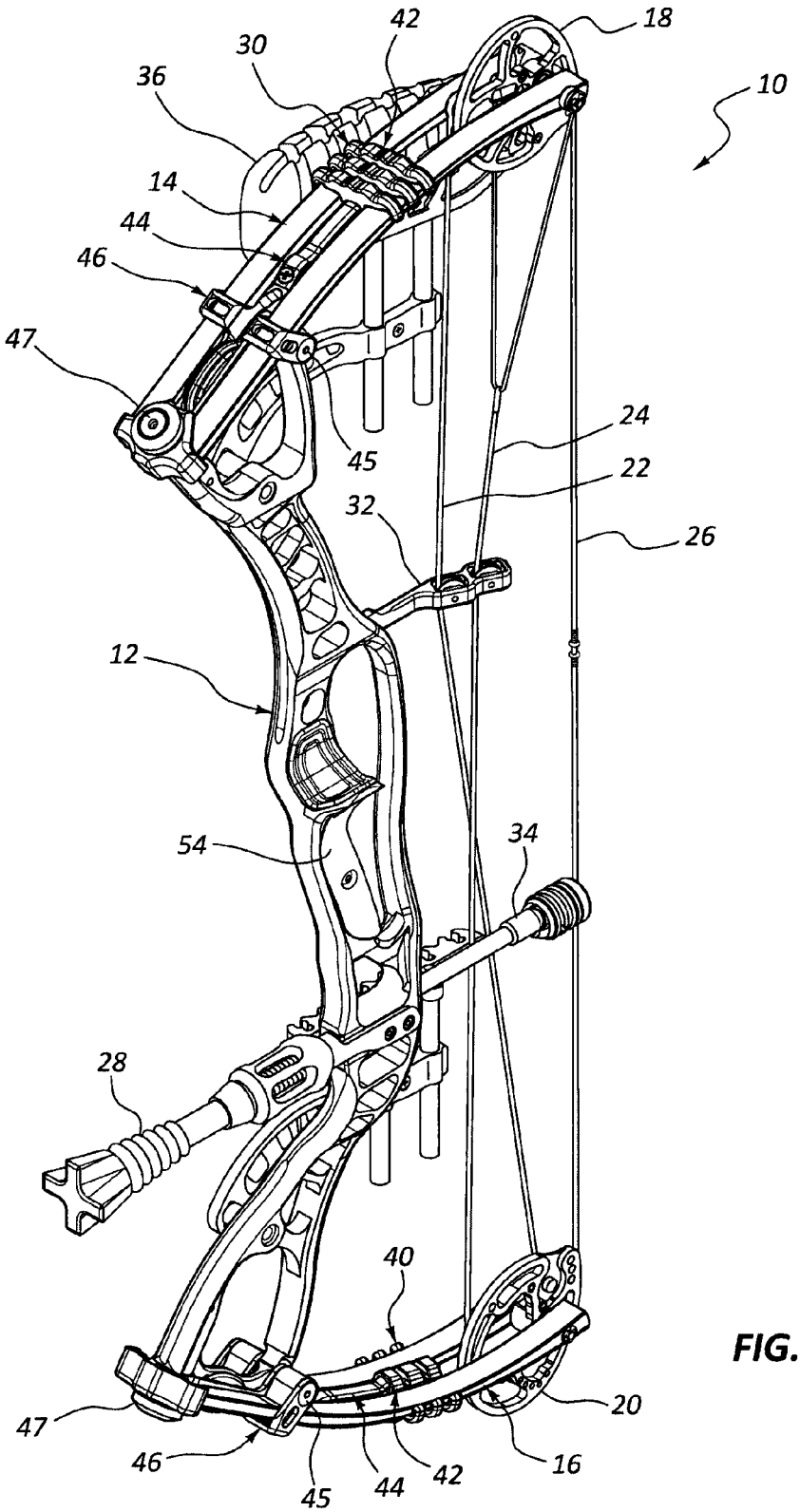
FIG. 1 is a perspective view of an archery bow having a plurality of dampening assemblies in accordance with the present disclosure.

Generally, the present disclosure relates to a device for dampening vibrations of a system. In further detail, the present disclosure relates to a device that includes a dampening member comprising a pliable, elastomeric material such as Santoprene™, which is a thermoplastic elastomer well known to those of ordinary skill in the art. Such an apparatus may provide dampening to a system. Also, the apparatus may be configured for selectively contacting portions of a system to provide dampening during certain aspects of system operation. In one embodiment, the dampening device is secured to an archery bow and dampens vibrations in a limb of the archery bow.

Dampening devices are commonly used to help reduce vibrations and movement of archery bows during use. The example dampening devices disclosed herein are typically mounted to a riser of the archery bow at a connection point of a limb to the riser. Dampening devices may help offset forces or actions that occur when launching an arrow from the archery bow.

One aspect of the present disclosure is directed to a dampening assembly for use with an archery bow, wherein the dampening assembly includes a cantilevered dampening member, more specifically comprising a dampening member coupled to a cantilever member, the cantilever member supporting the dampening member relative to a limb of the archery bow. One end of the cantilever member may be attached to at least one of the riser and a proximal end of the limb. An opposite end of the cantilever member is connected to the dampening member. The cantilever member holds the dampening member in a position wherein the dampening member is out of contact with the limb when the archery bow is drawn, and the dampening member contacts the limb when the archery bow is released to provide dampening of vibrations in the limb. The dampening member may be supported on the bow independent of the limb.

The cantilever member may be positioned in a channel that extends along at least a portion of the length of the limb. The dampening member may be positioned to contact a front facing surface of the limb, which is a side of the limb facing opposite the bow string. At least a portion of the dampening member may also be positioned in the slot of the limb within which the cantilever member is positioned.

In one example, the cantilever member is attached to a limb pocket of the riser. In another example, the cantilever is attached to a mounting bracket or limb pocket, wherein the limb pocket secures the limb to the riser. Alternatively, a separate cantilever bracket may be provided and may be mounted to one of the riser or the limb, or both.

The dampening member may include a plurality of dampening structures such as arms, protrusions or tabs that are connected together in part and include portions that are separated from each other with a recess or gap. Various portions of the dampening member may contact the limb at different locations. For example, a portion of the dampening member may contact a front facing surface of the limb while other portions contact side surfaces of the limb or surfaces of the channel within which at least portions of the dampening member and cantilever member are positioned. The dampening member itself may also comprise the cantilever member.

One advantage related to holding the dampening member out of contact with the limb when the bow is drawn is that the mass of the dampening member is not carried by the moveable portions of the limb and thereby is not carried through the drawing motion required to shoot an arrow using the bow. This enhances performance of the bow. Another advantage relates to the possible additional dissipation of shock forces and vibrations resulting from impact between the dampening member and the limb when the archery bow is released from the drawn position.

Figure 2:
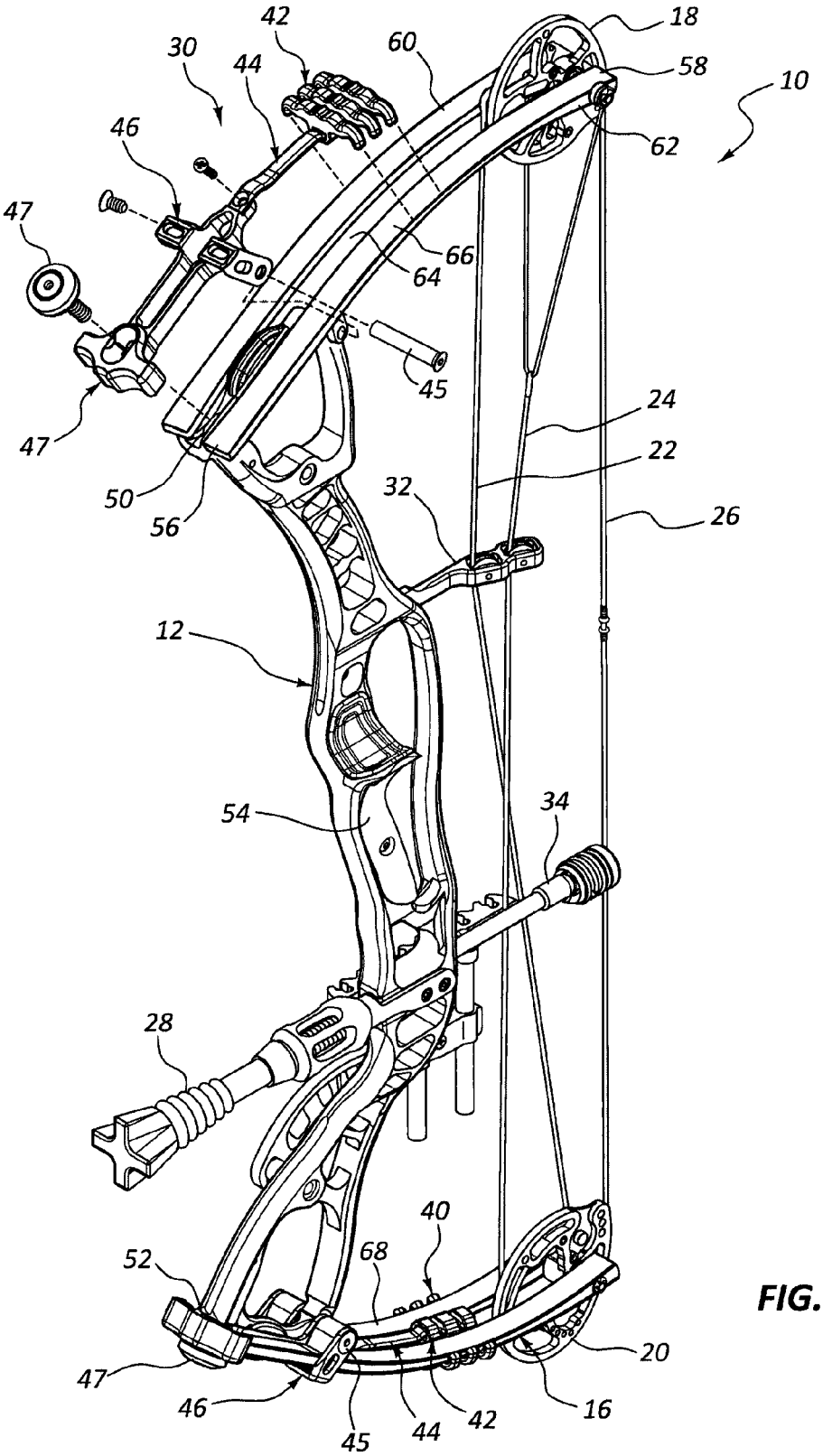
FIG. 2 is a partial exploded view of the archery bow of FIG. 1.

Referring now to FIGS. 1-2, an example archery bow 10 is shown including a riser 12, first and second limbs 14, 16, first and second cams 18, 20, cables 22, 24, and a bow string 26. The first and second limbs 14, 16 are mounted to opposing ends of the riser 12. The first and second cams 18, 20 are supported on distal ends of the first and second limbs 14, 16, respectively. The cables 22, 24 extend between the first and second cams 18, 20. The bowstring 26 also extends between the first and second cams 18, 20.

The archery bow 10 is typically operated by a user grasping the riser 12 about a handgrip 54 with one hand (e.g., the left hand) and pulling or drawing the bowstring 26 in a rearward direction away from the riser 12 with an opposite hand (i.e., the right hand). Drawing the bowstring 26 tends to flex the first and second limbs 14, 16 as the first and second cams 18, 20 move towards each other and the bowstring 26 moves rearward away from the riser 12. For compound bows of the types shown in the figures, the archery bow has a fully drawn position upon rotation of the first and second cams 18, 20 to a predetermined rotational degree. The archery bow 10 is in a rest or undrawn position shown in FIGS. 1, 4 and 8 and the drawn position shown in FIGS. 5 and 9. The archery bow 10 naturally moves from the drawn position to the rest or undrawn position upon releasing the bowstring 26.

The archery bow 10 may include a number of accessories mounted thereto. For example, the archery bow 10 may include a stabilizer 28, a cable guard 32, a bowstring silencer 34, a quiver 36, and first and second dampening assemblies 30, 40. At least some of these accessories create additional vibrations and movement of the archery bow 10, while other of the accessories reduce vibrations and movement during use. Any description herein related to the first dampening assembly 30 in association with the first limb 14 may be used to describe the second dampening assembly 40 in association with the second limb 16.

The first and second limbs 14, 16 are connected in first and second limb pockets 50, 52 at opposing ends of the riser 12. The first and second limbs 14, 16 each include first and second ends 56, 58, wherein the first end 56 is connected in the limb pocket and the second end carries one of the first and second cams 18, 20. The first and second limbs 14, 16 shown in the figures have a split limb design with first and second limb braces 60, 62 spaced apart laterally to define a channel 64 therebetween (see FIG. 2). Other types of limb designs may benefit from the dampening assemblies disclosed herein. For example, a single piece limb, with or without a groove or recess formed along at least a portion of its length, may benefit from the example dampening assemblies disclosed herein.

Figure 3:
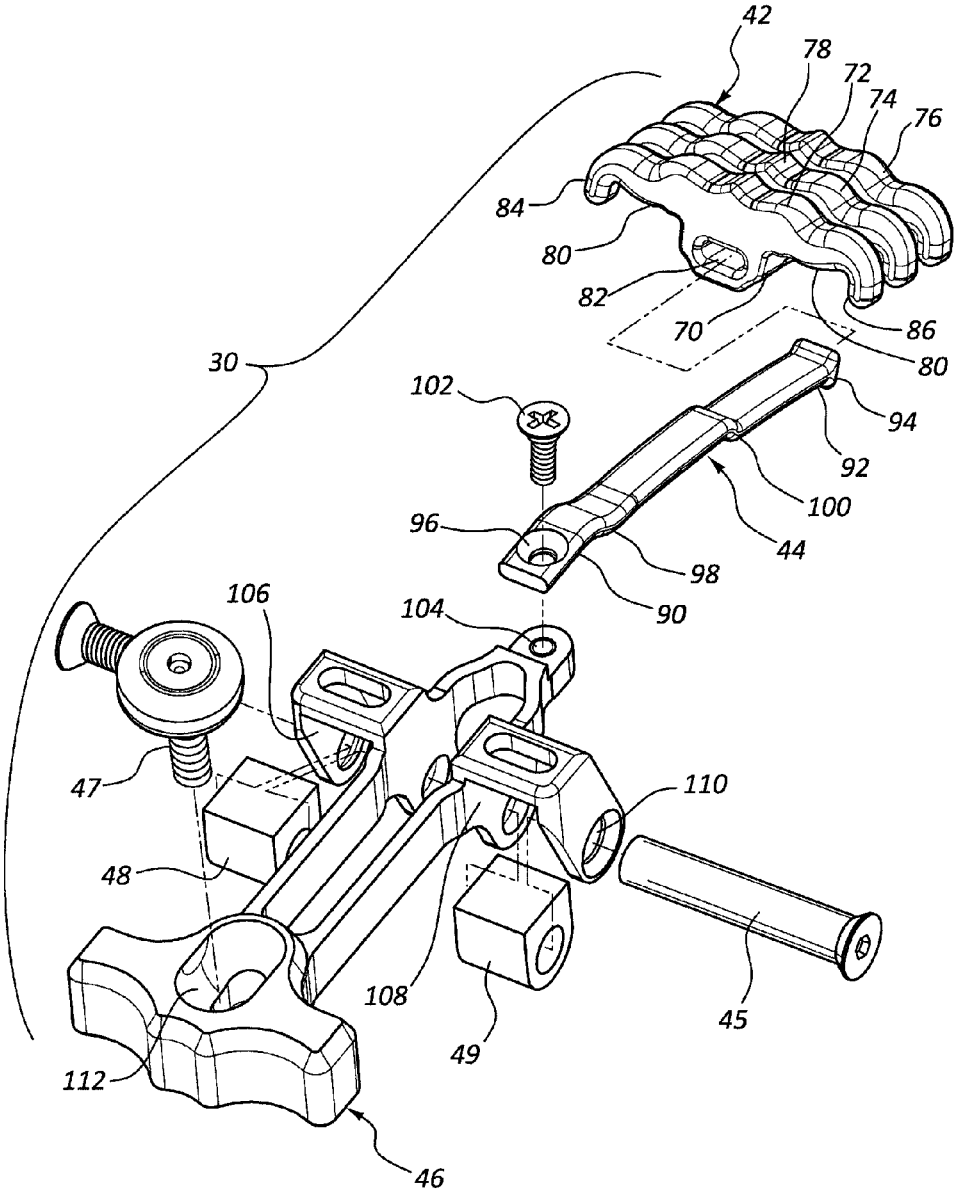
FIG. 3 is an exploded perspective view of one of the dampening assemblies of FIG. 1.

FIG. 3 shows the first dampening assembly 30 including a dampening member 42 and a cantilever member 44. In at least some arrangements, the first dampening assembly 30 may include additional features such as, for example, a fastener 45, a cantilever bracket 46, a limb bolt 47, and first and second spacers 48, 49. The first dampening assembly 30 may be preassembled and then assembled with the riser 12 and first and second limbs 14, 16 in later assembly steps.

The dampening member 42 may include a base portion 70, first, second and third dampening arms, 72, 74, 76, a top surface 78, a bottom surface 80, and an aperture 82 to receive a portion of a cantilever member 44. The dampening arms 72, 74, 76 may be arranged in parallel and spaced apart along a length of the first limb 14. In at least one example, the dampening arms 72, 74, 76 may be constructed as a single, unitary piece. Alternatively, each of the dampening arms 72, 74, 76 may be pre-formed and assembled with the other dampening arms using, for example, bonding or fasteners to provide a connection therebetween. Any suitable number of dampening arms may be used. Other dampening member constructions may be used to provide the same or similar benefits as discussed herein for dampening member 42.

The dampening arms 72, 74, 76 may include first and second arm ends 84, 86. The first and second arm ends 84, 86 may include portions that extend along side surfaces of the first limb 14 as shown in at least FIG. 1. The bottom surface 80 may extend across front facing surface 66 of the first limb 14 (see FIG. 2). The dampening member 42 may be arranged to remain out of a path of movement for the first limb 14 during operation of the archery bow 10 such that a rear surface 68 of the first limb 14 remains unobstructed by the dampening member 42 (see FIG. 2).

The aperture 82 may be sized to receive the cantilever member 44. The aperture 82 may provide an interference fit with the cantilever member 44. In at least some examples, the cantilever member 44 is structured to provide insertion of the cantilever member 44 into the aperture 82, but resist removal of the cantilever member 44 from the aperture 82. In other examples, the dampening member 42 is co-molded to the cantilever member 44. Co-molding the dampening member 42 to the cantilever member 44 may provide an improved connected therebetween.

While a single dampening member 42 is shown as part of the first dampening assembly 30, other embodiments may include two or more dampening members connected to a single cantilever member 44. Alternatively, a plurality of cantilever members may be arranged, for example, in parallel with each other, and be connected to one or more dampening members. The plurality of dampening members may contact the limb at different locations. The plurality of dampening members or plurality of cantilever members may provide contact of the dampening member(s) with the limb at any desired location along its path of movement between undrawn and drawn positions of the archery bow. The dampening assembly may provide dampening of different types of vibrations and movement of the limb (e.g., lateral, axial and front-to-back).

The cantilever member 44 may include first and second ends 90, 92, a retention portion 94 positioned at the second end 92, a connection aperture 96 positioned at the first end 90, and first and second bend sections 98, 100 positioned along a length thereof (see FIG. 3). Retention portion 94 may be configured and arranged to limit unintentional removal of the dampening member 42 from attachment to the cantilever member 44. The retention portion 94 may have any desired shape and size including, for example, a barbed shape, or a rounded or bulbous shape. The retention portion 94 may protrude into material of the dampening member 42 to provide an interference fit within the aperture 82.

A cantilever fastener 102 may extend through the connection aperture 96 into a cantilever aperture 104 of the cantilever bracket 46 to provide a releasable connection therebetween. The releasable connection between the cantilever member 44 and the cantilever bracket 46 may provide easier removal and/or adjustment of the dampening member 42 and cantilever member 44 relative to the riser 12 and first limb 14. Other arrangements may include the cantilever member 44 being integrally formed as a single piece with the cantilever bracket 46. Alternatively, the cantilever member 44 may be permanently connected to the cantilever bracket 46. Alternatively, the member 44 may be supported in a non-cantilever arrangement.

The cantilever member 44 may comprise different materials than the dampening member 42 and the cantilever bracket 46. In one example, the cantilever member 44 comprises a metal material that is relatively rigid. The cantilever member 44 may comprise other materials such as, for example, polymers or composite materials. The cantilever member 44 may, through at least one of its material composition and its construction, have at least some flexibility and elasticity that promotes additional shock absorption by the first dampening assembly 30.

The first and second bend sections 98, 100 may help arrange the dampening member 42 at a proper angle so that the bottom surface 80 of the dampening member 42 is aligned parallel with the front surface 66 of the first limb 14. The first and second bend sections 98, 100 may provide additional flexing and elastic bending of the cantilever member 44 when the first limb 14 moves into contact with the dampening member 42. Other embodiments are possible for the cantilever member wherein a different number of bend sections are included. Further, the cantilever member 44 may have different cross-sectional shapes, lengths, thicknesses, and other features than those shown in the figures to customize the absorption and dissipation of vibrations in the first limb 14.

The cantilever bracket 46 may include, in addition to the cantilever aperture 104 mentioned above, first and second limb channels 106, 108, a spacer connection aperture 110, and a limb bolt aperture 112. The first and second limb channels 106, 108 are sized to receive the first end 56 of the first limb 14. The spacers 48, 49 may also be positioned within the first and second limb channels 106, 108 to help hold the first limb 14 within the cantilever bracket 46. The fastener 45 extends through the spacer connection aperture 110 and the spacers 48, 49. The limb bolt aperture 112 receives the limb bolt 47 for connection of the cantilever bracket 46, and consequently the first limb 14 and the first dampening assembly 30, to the riser 12. In at least one example, the first limb 14 is assembled with the cantilever bracket 46, spacers 48, 49 and fastener 45 prior to connecting the cantilever bracket 46 with the limb bolt 47. The cantilever member 44 may be connected to the cantilever bracket 46 prior to or after connecting the cantilever bracket 46 to the riser 12 or the first limb 14.

Figure 4:
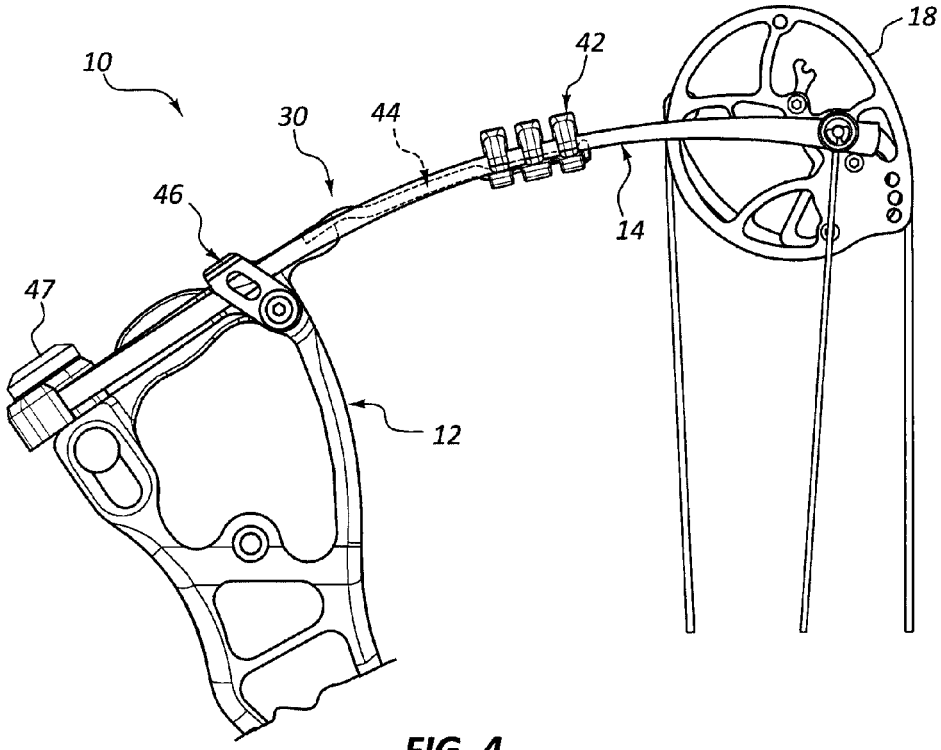
FIG. 4 is a side view of the archery bow of FIG. 1 in an undrawn position.
Figure 5:
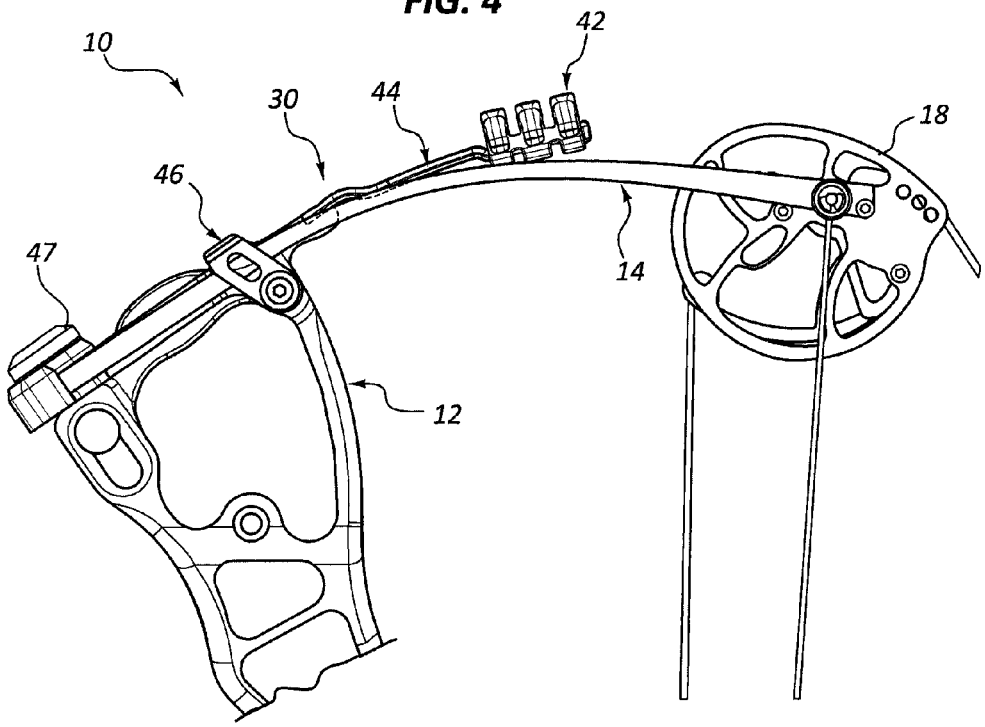
FIG. 5 is a side view of the archery bow of FIG. 1 in a drawn position.
Figure 6:
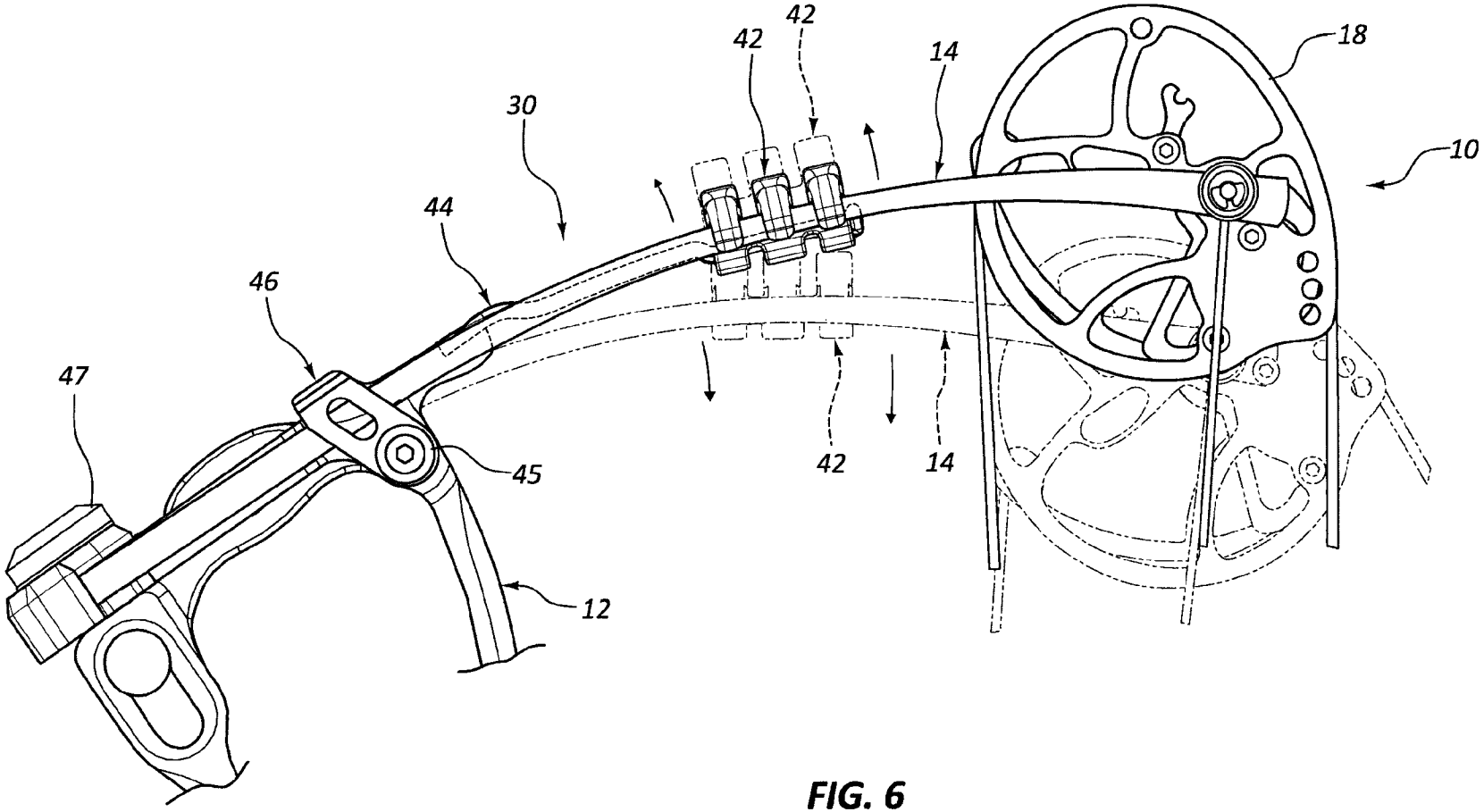
FIG. 6 is a side view of the archery bow of FIG. 1 in a released position with the dampening member operating to dampen vibrations in the archery bow.

Referring now to FIGS. 4-6, the first dampening assembly 30 is shown in use with the archery bow 10 to dampen vibrations in the first limb 14. FIG. 4 shows the archery bow 10 in a rest position with the dampening member 42 in contact with the front surface 66 of the first limb 14. FIG. 5 shows the archery bow in a drawn position with the first limb 14 moved away from the dampening member 42. The cantilever member 44 maintains the dampening member 42 in the same position as when the first limb 14 is in the rest position shown in FIG. 4. Upon release of the bowstring (e.g., to shoot an arrow), the archery bow moves from the drawn position of FIG. 5 back towards the rest position. FIG. 6 shows the first limb 14 returned into contact with the dampening member 42. The dampening member 42 may flex and move to absorb energy and dampen vibrations in the first limb 14 as reflected in FIG. 6.

The cantilever member 44 may have a relatively stiff construction that helps maintain the dampening member 42 in a fixed position when the first limb 14 moves into the drawn position as shown in FIG. 5. A relatively stiff construction for the cantilever member 44 may result in greater impact forces between the dampening member 42 and the first limb 14 upon return of the first limb 14 from the drawn position as compared to more flexible constructions.

Figure 7:
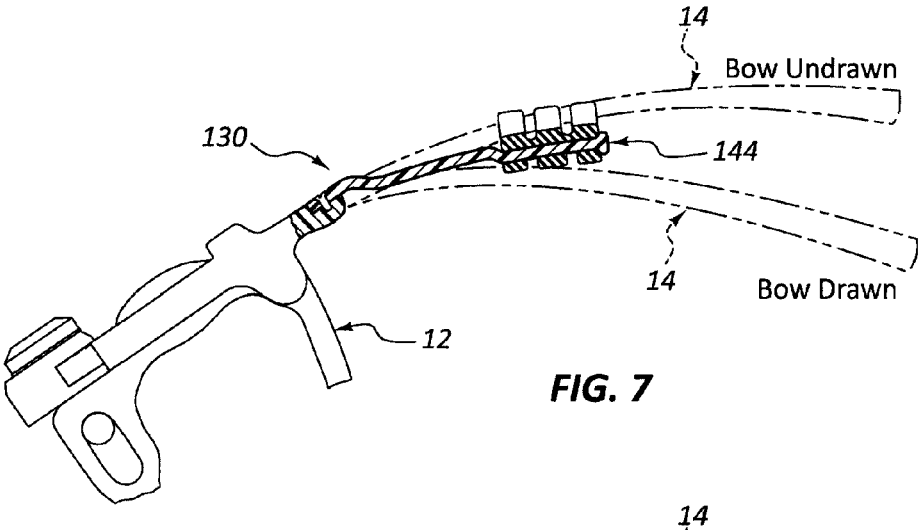
FIG. 7 is a side view of the archery bow of FIG. 1 with an alternative dampening assembly.

FIGS. 7-10 illustrate another example first dampening assembly 130 having a cantilever member 144 with greater flexibility properties. The cantilever member 144 may have a rest position as shown in FIG. 7 that positions the dampening member 42 closer to the first limb 14 when the first limb 14 is in the drawn position (see FIG. 9) as compared to a position of the dampening member 42 when the first limb 14 is in the undrawn position (see FIG. 8). The cantilever member 144 may be biased into the position shown in FIG. 8 due to elastic or resilient properties of the cantilever member 144. Alternatively, a connection between the cantilever member 144 and the cantilever bracket 46 may provide movement of the dampening member 42 between the rest position shown in FIG. 7 and the position shown in FIG. 8 when the first limb 14 is in the undrawn position.

Figure 8:
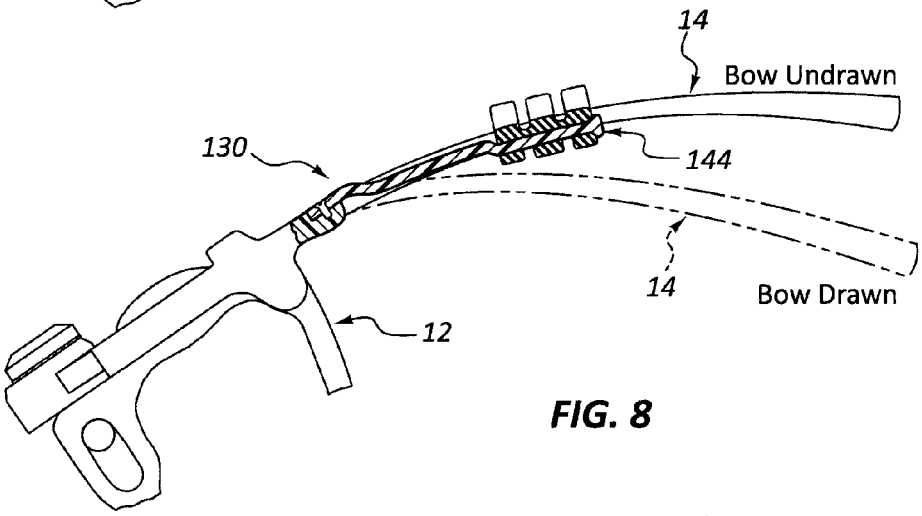
FIG. 8 is a side view of the archery bow of FIG. 7 in an undrawn position.
Figure 9:
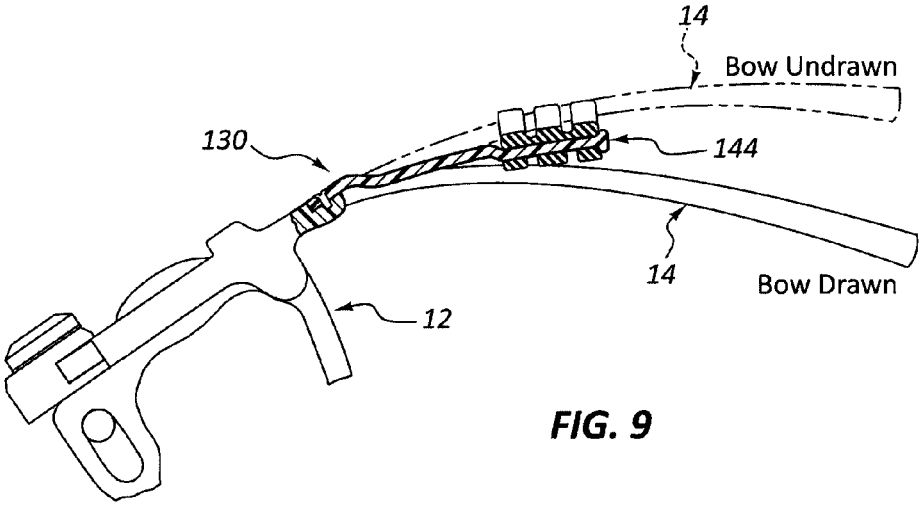
FIG. 9 is a side view of the archery bow of FIG. 7 in a drawn position.

FIG. 7 shows the cantilever member 144 in a rest position with the first limb 14 shown in broken lines in drawn and undrawn positions. FIG. 8 shows the first limb 14 in an undrawn position and the cantilever member 144 in a biased or displaced position. FIG. 9 shows the first limb 14 in a drawn position with the cantilever member 144 in the rest position.

Figure 10:
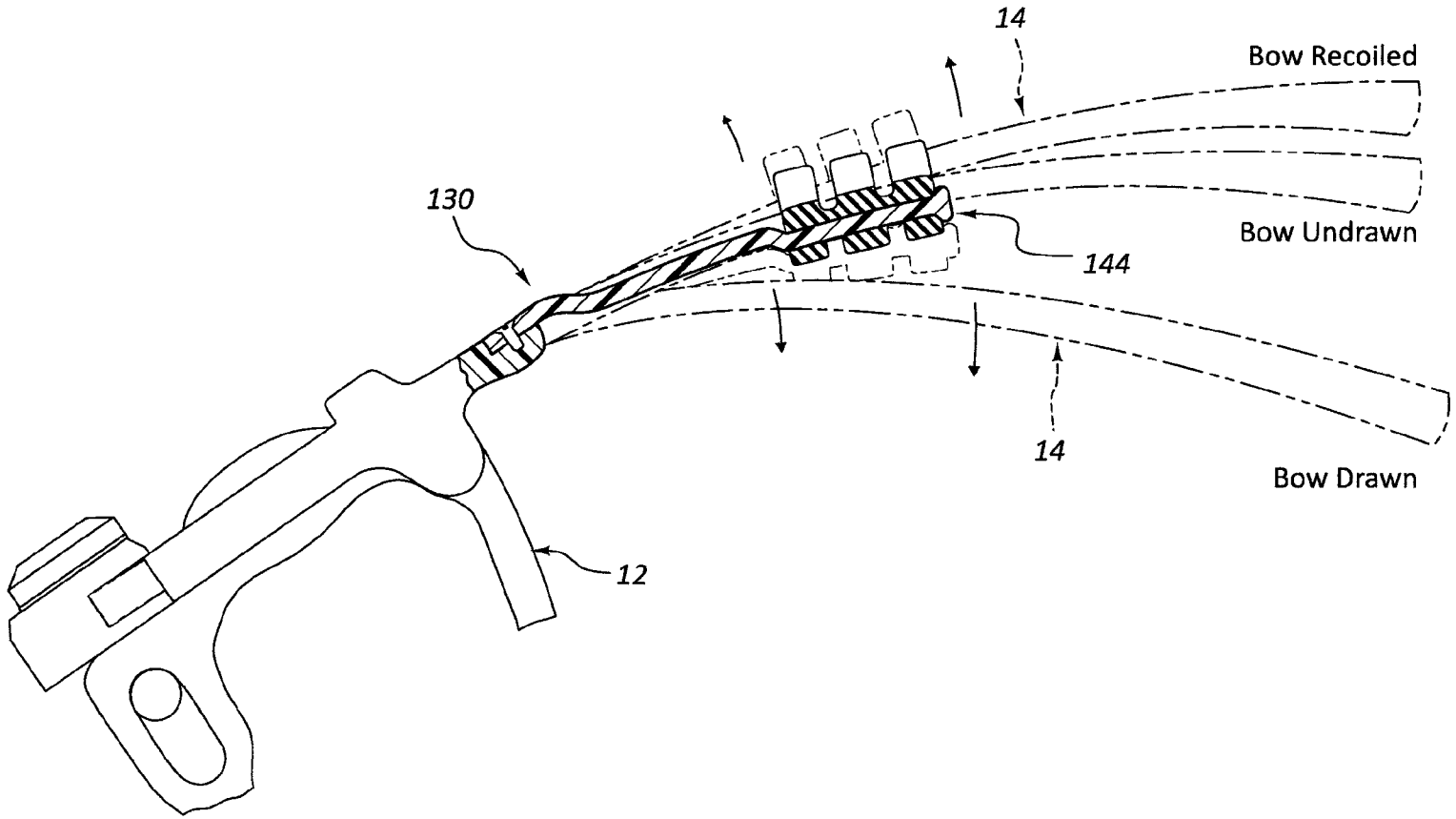
FIG. 10 is a side view of the archery bow of FIG. 7 in a released position with the dampening member operating to dampen vibrations in the archery bow.
Figure 11:
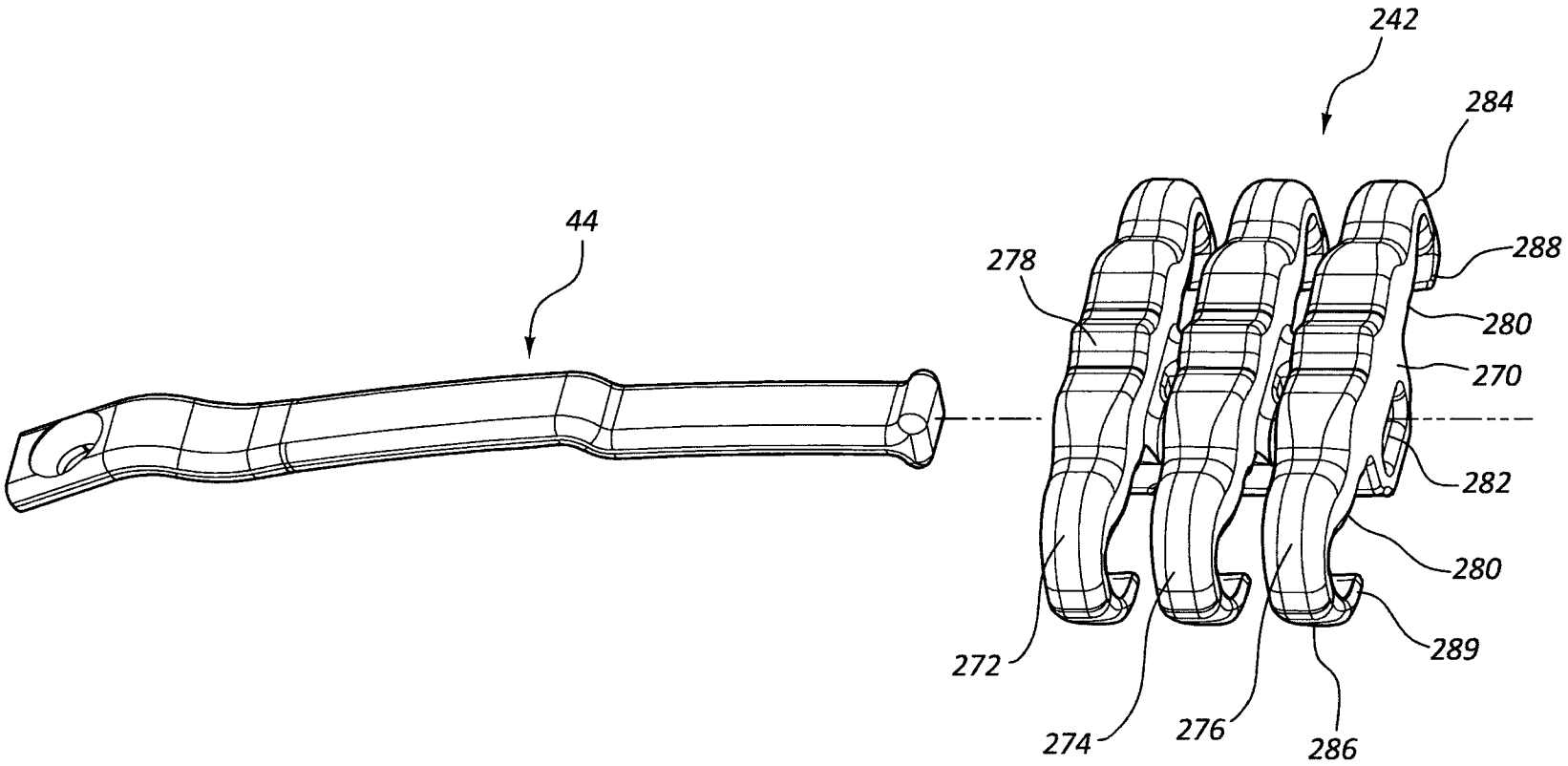
FIG. 11 is an exploded perspective view of a portion of another example dampening assembly in accordance with the present disclosure.

FIG. 10 shows the first limb 14 released from the drawn position of FIG. 9 back towards the undrawn position of FIG. 8. The first limb 14 makes initial contact with the dampening member 42 at a location between the undrawn position of the first limb 14 (see FIG. 8) and the drawn position of the first limb 14 (see FIG. 9). Typically, the dampening member 42 and the cantilever member 44 both absorb energy and vibrations beginning with the initial contact of the first limb 14 with the dampening member 42 and continue such absorption of energy and vibrations as the first limb 14 moves into the rest position as shown in FIG. 10.

The first limb 14 may move past the undrawn position to a recoiled position upon release of the archery bow 10 from the drawn position as shown with broken lines in FIG. 10. The dampening assembly 130 may help the archery bow settle in the undrawn position more quickly as compared to other types of dampening system, including the dampening assembly 30.

FIGS. 11-14 show another example dampening member 242 having features that provide a "grab" or wrap around effect at an interface between the dampening member 242 and the first and second limbs 14, 16 of the archery bow for at least a portion of a draw cycle of the archery bow. The dampening member 242 includes a base 270, first, second and third dampening arms 272, 274, 276, a top surface 278, a bottom surface 280, and an aperture 282 sized to receive the cantilever member 44. The dampening arms 272, 274, 276 each include first and second arm side portions 284, 286 and first and second arm bottom portions 288, 289. The bottom surface 280 extends along the front surface 66 of limb 14. The first and second arm side portions 284, 286 extend along side surfaces 67 of the limb 14. The first and second arm bottom portions 288, 289 extend along the rear surface 68 of the limb 14.

Figure 12:
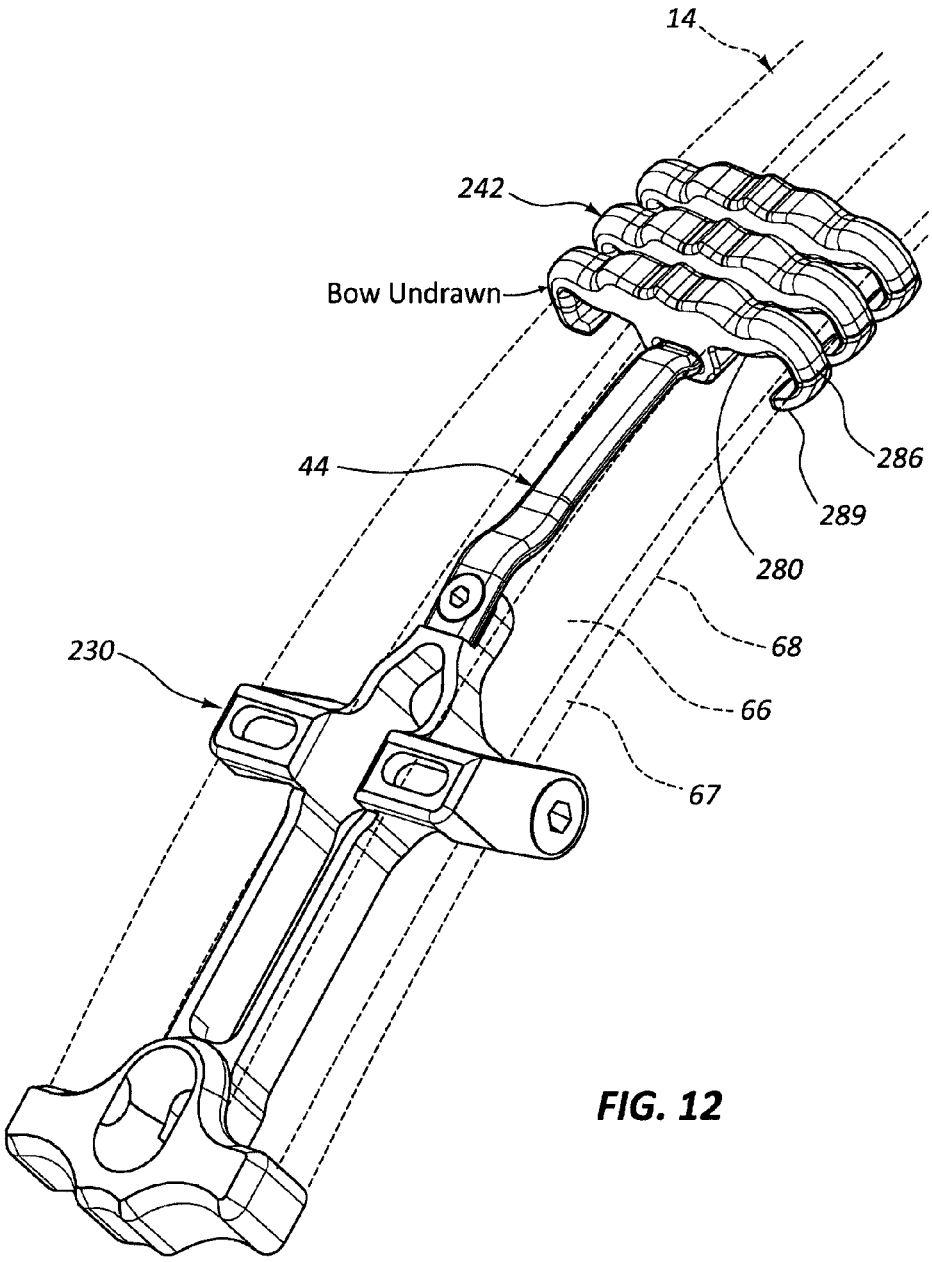
FIG. 12 is a perspective of the dampening assembly of FIG. 11 mounted to an archery bow with the archery bow in an undrawn position.
Figure 13:
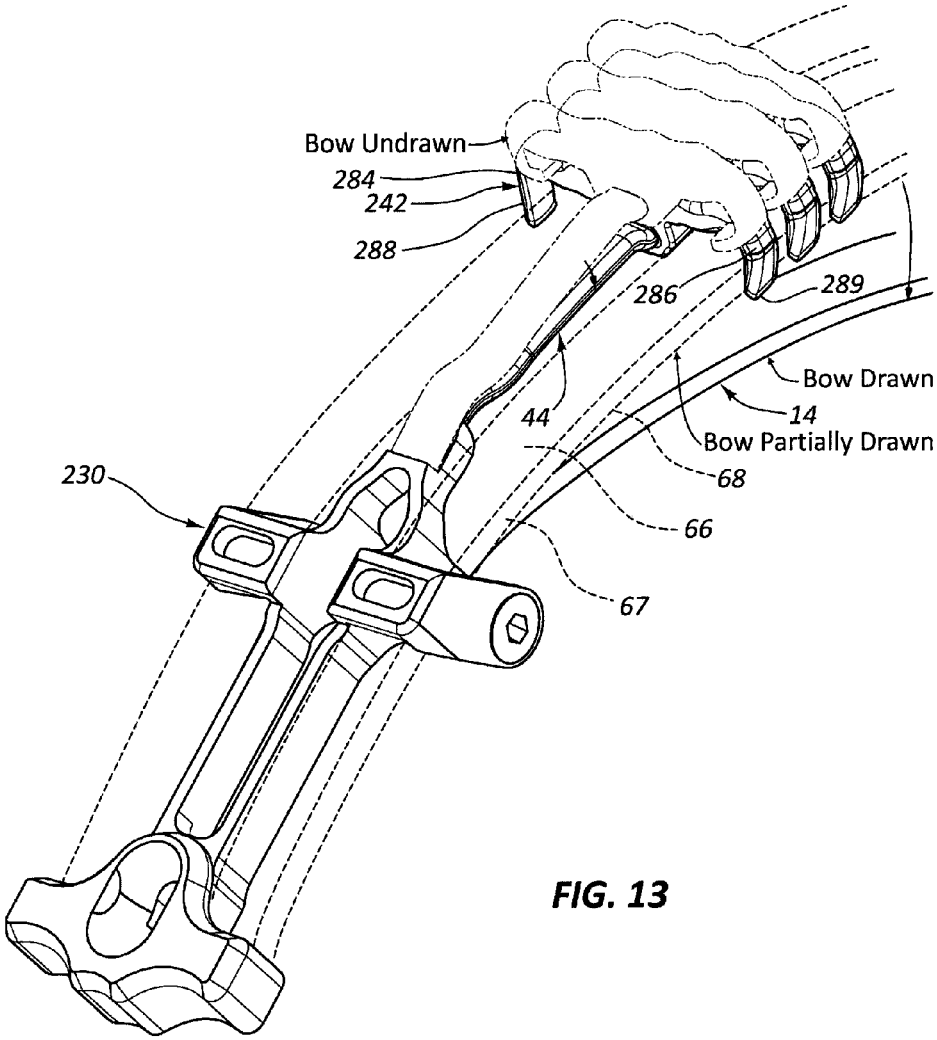
FIG. 13 is a perspective view of the dampening assembly of FIG. 12 with the archery bow being drawn.

Referring to FIG. 12, the first and second arm bottom portion 288, 289 wrap around the limb 14 to contact the rear surface 68 when the bow is undrawn. The first and second arm bottom portions 288, 289, as well as the first and second arm side portions 284, 286 help maintain contact between the limb 14 and the dampening member 242. This contact may help limit vibrations and maintain stability in the bow when the bow is undrawn. FIG. 13 shows the first and second arm bottom portions 288, 289 flex outward as the bow is moved from the undrawn position of FIG. 12 toward the drawn position. The dampening member 242 may move with the limb 14 through a portion of the draw cycle from the undrawn to drawn positions as shown in FIG. 13. At some point in the draw cycle, the dampening member 242 pulls away from the limb 14 and returns to an "unloaded" position, which is typically near a position of the dampening member 242 when the bow is undrawn.

Figure 14:
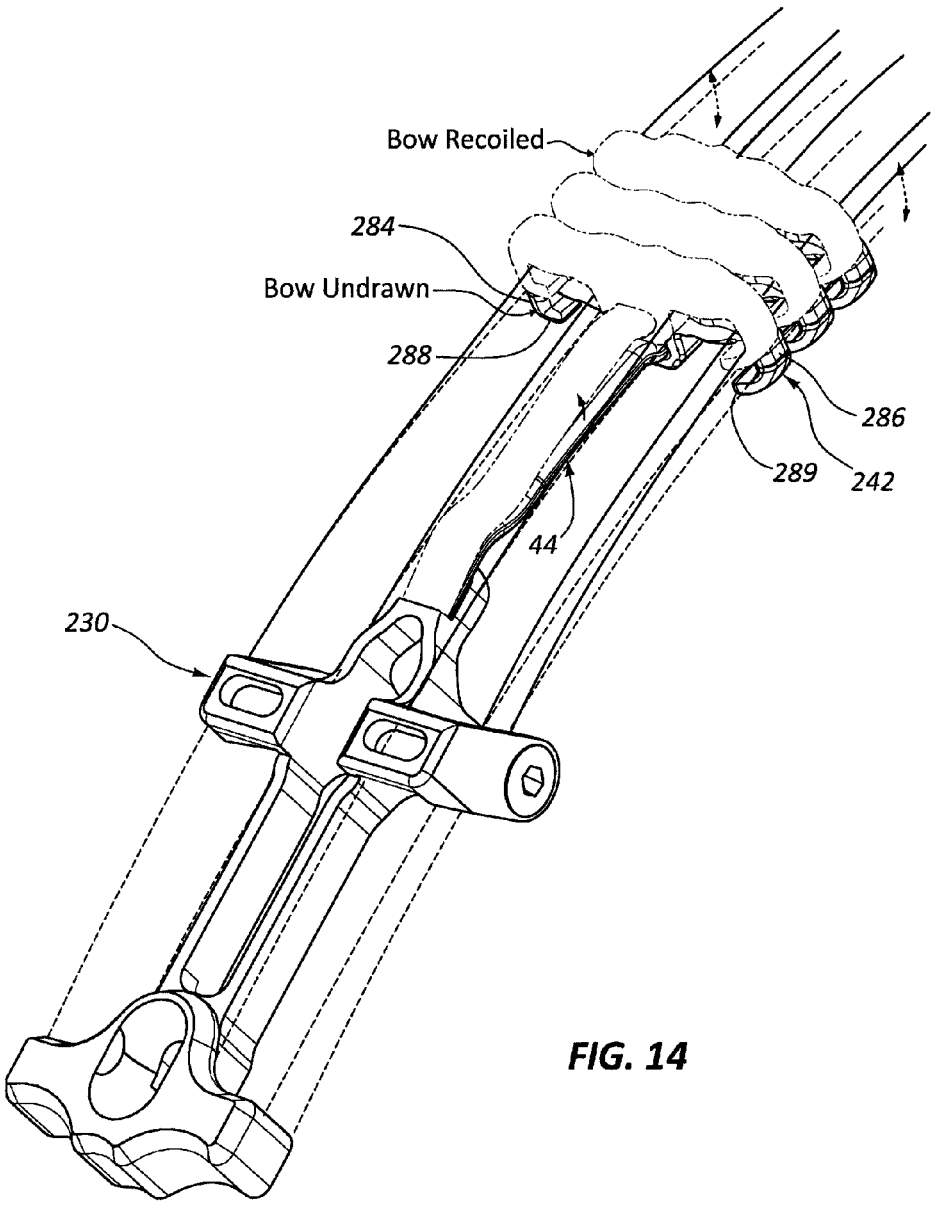
FIG. 14 is a perspective view of the dampening assembly of FIG. 13 with the archery bow released from the drawn position.

When the bow is released from the drawn position (e.g., when an arrow is shot by the bow), the limb 14 travels forward to the undrawn position and engages the dampening member 242 as shown in FIG. 14. The dampening member 242 "grabs" the limb 14 by wrapping the first and second arm bottom portions 288, 289 around the limb 14 and into contact with the rear surface 68. The dampening member 242 may more effectively reduce vibrations in the limb 14 in forward and rearward directions (e.g., limb flutter and recoil) when the dampening member 242 is "grabbing" or "wrapping around" at least portions of the limb 14. The "grabbing" or "wrapping around" may include contact between the dampening member 242 and portions of the side surfaces 67 and/or portions of the rear surface 68.

The embodiments of FIGS. 7-14 may provide reduced impact forces resulting from initial contact between the first limb 14 and the dampening member 42, 242. The reduced impact forces may result from the material composition and construction of the cantilever member 44 as well as the position of the dampening member 42, 242 in the path of movement of the first limb 14 at a location different than the final rest position of the first limb 14.

Various methods of stabilizing an archery bow and dissipating forces and vibrations during use of the archery bow are possible using the dampening assemblies disclosed herein. One method includes providing an archery bow having a riser, first and second limbs extending from limb pockets of the riser, and a vibration dampening member. The method includes spacing the dampening member away from the first limb when the archery bow is drawn, and contacting the dampening member with the first limb when the archery bow is released (e.g., to shoot an arrow) to dampen vibrations in the archery bow. Spacing the dampening member away from the first limb may include suspending the dampening member with a cantilever member, wherein one end of the cantilever member is coupled to at least one of the riser and a proximal end of the first limb, and an opposite end of the cantilever member is connected to the dampening member. The cantilever member may be coupled to the riser and first limb with a cantilever bracket or other structure that is connected to a limb pocket of the riser. The cantilever bracket or other connecting structure may concurrently connect the first limb to the riser and connect the dampening assembly to at least one of the riser and the first limb.

Another example method relates to contacting a limb of an archery bow at select locations along the limb's path of motion. The first limb of the archery bow may move through a path of motion as the archery bow is moved between a rest position and a drawn position in which the archery bow is ready to shoot an arrow. The first limb may be in contact with the dampening member through a portion of the path of motion and may be separated from the dampening member through another portion of the path of motion. As the first limb moves back to the rest position from the drawn position of the archery bow, the dampening member may be spaced from the first limb through a portion of the return path of motion and be in contact with the first limb through a different portion of the return path of motion. The dampening member may dampen vibrations and other forces in the archery bow whenever the dampening member is in contact with the first limb. The dampening member may provide at least some dampening of vibrations and other forces in the archery bow even when out of contact with the first limb (e.g., forces traveling through the riser and cantilever member into the dampening member).

Another method relates to concurrently dampening vibrations in both limbs of an archery bow. The archery bow may include first and second dampening members that are held out of contact with respective first and second limbs when the bow is drawn, and contact the respective first and second limbs through at least a portion of a path of motion of the first and second limbs from the drawn position to a final rest position attained after releasing the bow to shoot an arrow. The first and second dampening members may be suspended using first and second cantilever members, respectively. The first and second cantilever members may be coupled to opposing first and second ends of the riser of the archery bow, respectively. The first and second cantilever members may be coupled to the riser using first and second cantilever brackets, which are connected to the first and second ends of the riser, respectively. The first and second cantilever brackets may define, at least in part, first and second limb pockets that connect respective first and second limbs to the riser.

Although the above-discussion references archery systems, the present invention may also relate to other systems that may experience vibration.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" may connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An archery bow, comprising:

a riser having opposing ends;

first and second limbs extending from the opposing ends of the riser;

a bowstring extending between the first and second limbs;

a vibration dampening assembly comprising:

a dampening member;

a cantilever member having a first end mounted to the riser and a second end supporting the dampening member;

wherein the dampening member is suspended by the cantilever member out of contact with the first limb when the archery bow is drawn and contacts the first limb to dampen vibrations when the archery bow is released.

2. The archery bow of claim 1, wherein the riser includes first and second limb pockets, the first and second limbs being connected to the riser at the first and second limb pockets, respectively, and the cantilever member is connected to the first limb pocket.

3. The archery bow of claim 1, wherein the cantilever member includes a cantilever bracket that couples the cantilever member to the riser.

4. The archery bow of claim 1, wherein the first and second limbs are split limbs having a channel formed therein, and the cantilever member is positioned in the channel.

5. The archery bow of claim 1, wherein the first and second limbs have a front surface and a rear surface, the rear surface facing the bowstring, and the dampening member contacts the front surface.

6. The archery bow of claim 1, wherein the cantilever member has a rest position and a biased position, wherein releasing the archery bow moves the cantilever member from the rest position into the biased position.

7. The archery bow of claim 1, wherein the dampening member comprises a thermoplastic elastomer.

8. The archery bow of claim 1, wherein the cantilever member comprises a different material than the dampening member.

9. The archery bow of claim 1, wherein the dampening member engages at least one of side and rear surface of the first limb during a portion of a draw cycle of the archery bow between a rest position and a drawn position.

10. The archery bow of claim 1, wherein the first limb comprises first and second end portions, the first end portion being connected to the riser and the second end portion carrying a cam of the archery bow, and the dampening member contacts the first limb at a location spaced between the first and second end portions.

11. The archery bow of claim 1, further comprising first and second vibration dampening assemblies each comprising a dampening member and a cantilever member, the first vibration dampening assembly mounted at one end of the riser and arranged to contact the first limb, and the second vibration dampening assembly mounted to an opposite end of the riser and arranged to contact the second limb.

12. An archery bow dampening assembly, comprising:

a dampening member;

a cantilever member having a first end configured to be coupled to a riser of an archery bow and a second end connected to the dampening member;

wherein the cantilever member is operable to hold the dampening member out of contact with a limb of the archery bow when the archery bow is drawn and allow the dampening member to contact the limb to dampen vibrations when the archery bow is released.

13. The archery bow of claim 12, further comprising a cantilever bracket configured to connect the cantilever member to the riser.

14. The archery bow of claim 12, wherein the dampening member comprises a plurality of dampening segments arranged adjacent to each other along a length dimension of the limb.

15. The archery bow of claim 12, wherein the cantilever member is configured to be coupled to a limb pocket of the riser.

16. A method of stabilizing an archery bow, comprising:

providing an archery bow having a riser, first and second limbs extending, from limb pockets of the riser, and a dampening member;

spacing the dampening member away from the first limb when the archery bow is in a drawn position;

contacting the dampening member with the first limb when the archery bow is released from the drawn position to dampen vibrations in the archery bow.

17. The method of claim 16, wherein the archery bow further comprises a cantilever member having a first end connected to at least one of the riser and the first limb and a second end connected to the dampening member, wherein the cantilever member holds the dampening member away from the first limb when the archery bow is in the drawn position.

18. The method of claim 17, further comprising dampening vibrations with the cantilever member when the dampening member contacts the first limb.

19. The method of claim 16, wherein the first limb moves away from the dampening member when the archery bow is in the drawn position.

20. The method of claim 16, wherein the first limb has a front surface and a rear surface, the dampening member being arranged to contact the front surface.

21. An archery bow, comprising:

a riser having opposing ends, the riser having first and second limb pockets;

first and second limbs extending from the opposing ends of the riser, the first and second limbs being connected to the riser at the first and second limb pockets, respectively;

a bowstring extending between the first and second limbs;

a vibration dampening assembly comprising:

a dampening member;

a cantilever member having a first end mounted to the riser and a second end supporting the dampening member, the cantilever member being connected to the first limb pocket;

wherein the dampening member is suspended by the cantilever member out of contact with the first limb when the archery bow is drawn and contacts the first limb to dampen vibrations when the archery bow is released.

22. An archery bow dampening assembly, comprising:

a dampening member comprising a plurality of dampening segments;

a cantilever member having a first end configured to be coupled to a riser of an archery bow and a second end connected to the dampening member;

wherein the cantilever member is operable to hold the dampening member out of contact with a limb of the archery bow when the archery bow is drawn and allow the dampening member to contact the limb to dampen vibrations when the archery bow is released;

wherein the dampening segments are arranged adjacent to each other along a length dimension of the limb.

23. An archery bow dampening assembly, comprising:

a dampening member;

a cantilever member having a first end configured to be coupled to a riser of an archery bow and a second end connected to the dampening member, the cantilever member being configured to be coupled to a limb pocket of the riser;

wherein the cantilever member is operable to hold the dampening member out of contact with a limb of the archery bow when the archery bow is drawn and allow the dampening member to contact the limb to dampen vibrations when the archery bow is released.

* * * * *